United States Patent [19]

Tetro et al.

[11] 4,199,118

[45] Apr. 22, 1980

[54] METHOD AND APPARATUS FOR CONTROLLING THE BRAKING SYSTEM FOR AN UNWINDER

[75] Inventors: Richard S. Tetro; Gerald F. Browning, both of Fulton, N.Y.

[73] Assignee: The Black Clawson Company, Fulton, N.Y.

[21] Appl. No.: 2,405

[22] Filed: Jan. 10, 1979

[51] Int. Cl.[2] ..... B65H 25/22; B65H 59/00

[52] U.S. Cl. ..... 242/75.44; 242/75.51

[58] Field of Search ..... 242/75.51, 75.5, 75.44, 242/75.4, 75.45; 318/6, 7

[56] References Cited

U.S. PATENT DOCUMENTS

| | | | |
|---|---|---|---|
| 2,983,464 | 5/1961 | Fuller | 242/75.44 |
| 3,049,313 | 8/1962 | Jordan | 242/75.44 |
| 3,249,316 | 5/1966 | Loase | 242/75.44 |
| 3,936,008 | 2/1976 | Crum | 242/75.44 |
| 4,015,794 | 4/1977 | Meihofer | 242/75.44 |

*Primary Examiner*—Edward J. McCarthy
*Attorney, Agent, or Firm*—Biebel, French & Nauman

[57] ABSTRACT

A brake control system for an unwinder is provided which measures the line speed of the moving web and the rpm of the roll and produces electrical output signals proportional to each which signals are operated upon to produce a main brake control signal to apply a braking force proportional to the roll diameter as it is constantly decreasing, and a further output signal which is proportional to the energy in the roll so that additional braking force modification will occur during acceleration and deceleration of the web in order to maintain essentially constant web tension. An additional feedback from a web tension measuring device is also provided which adjusts the braking force to produce an actual tension equal to the desired tension which has been included in the main braking force output signal proportional to the roll diameter.

10 Claims, 1 Drawing Figure

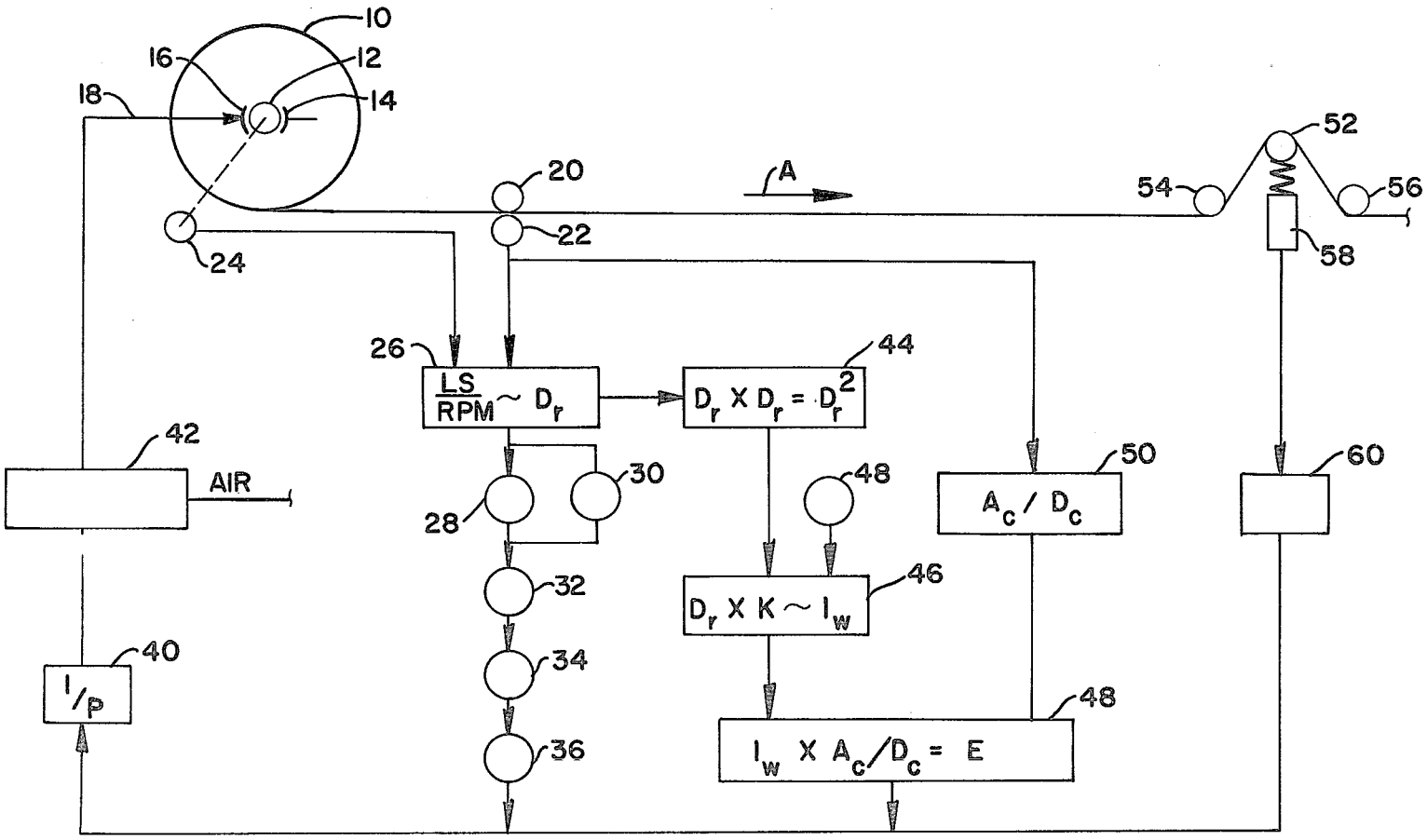
A
$A_c / D_c$
$D_r \times D_r = D_r^2$
$D_r \times K \sim I_w$
$I_w \times A_c/D_c = E$
$\frac{LS}{RPM} \sim D_r$
AIR
I/P

METHOD AND APPARATUS FOR CONTROLLING THE BRAKING SYSTEM FOR AN UNWINDER

BACKGROUND OF THE INVENTION

1. Field of the Invention

The present invention relates to a braking system for an unwinder of rolls of web material, and more particularly, to a braking system which maintains uniform tension on the web material downstream of the unwinding device as a roll of web material is unwound.

2. Prior Art

In unwinding devices such as those employed in the paper industry for unwinding large rolls of paper web it is generally necessary to apply some degree of braking force to the roll of web as it is being unwound in order to maintain a uniform tension on the web for processing through various types of paper processing machinery downstream of the unwinding apparatus. Some of the rolls of paper which are so processed are fairly large in diameter, for example sixty inches. This size of roll possesses fairly large inertia when it is rotated at the high rotational speeds necessary to achieve the high line speeds for processing of web material in modern equipment.

Since there are numerous occasions upon which the speed of the roll being unwound is either increased or decreased the braking forces applied to the roll must be adjustable in order to compensate for the inertia of the roll so as to maintain uniform tension in the web and prevent breakage of the web or reductions in tension. As the roll diameter decreases during the unwinding process the inertia of the roll likewise decreases and the braking forces required to maintain uniform tension should also be modified accordingly.

In less sophisticated prior art systems the braking force is adjusted manually by the operator maintaining vigilence over a tension measuring device which constantly monitors the tension on the web downstream from the unwinder and indicates to the operator whether or not the tension is as desired. Such a system obviously has several drawbacks particularly since the reaction time of the operator may not be sufficiently rapid to prevent breakage of the web should the tension increase rapidly for any reason. Also, it requires the operator to maintain constant vigilence over the tension and make multiple adjustments in the braking force as the roll diameter of the roll of web material being unwound decreases.

A more suitable prior art system utilizes a tension measuring device which provides continuous feedback to the braking system for automatic adjustment of the braking force when the tension in the web changes from the desired level. Such systems utilize the feedback signal to control the tension throughout the unwinding of the roll as well as for correcting for tension upsets which occur in the system. Since such systems do not take into account the roll diameter they must constantly increase or decrease the braking force applied to the roll until the proper tension level is reached.

The problem with this type of system is that it does not take into account changes in roll diameter during application of the braking force. Thus, a predetermined average braking force is usually programmed into the system and this braking force is too large to be applied to a roll which is almost completely unwound and too small to be applied to a new roll. With such systems, particularly when a roll has been substantially decreased from the nominal diameter used to establish the braking force, where almost instantaneous tension changes occur a rapid change in braking force would occur which could cause either braking of the web if the braking force is greatly increased or loss in tension due to a rapid releaving of the braking force.

In an attempt to solve the difficulties with the direct tension measuring feedback circuit, a system was developed which calculates the roll diameter continuously and applies proportional braking force to the roll to maintain a predetermined tension in the web. This is accomplished by measuring the line speed and the rpm of the roll of web material and then dividing the line speed by the rpm to determine the radius or diameter of the roll at that instant. The braking force is then proportioned for the given roll diameter by introducing a constant multiplier factor established by the operator for a desired web tension. The arbitrary constant is introduced by the operator into the braking force system by manual settings and is intended to compensate for the inertia of the roll. However, as the roll diameter decreases the actual inertia of the roll will change and thus the constant will not be accurate for the entire range of roll diameters as the roll is unwinding. Thus, with this system some variation in tension will occur due to the difference between the actual inertia of the roll and the calculated braking force based on the arbitrary constant intended to represent the roll inertia.

SUMMARY OF THE INVENTION

The present invention overcomes the above described difficulties and disadvantages associated with such prior art devices by providing a brake control mechanism for a web unwinding apparatus which takes into account the actual roll diameter and continuously calculates the actual inertia of the roll as its diameter decreases. This provides an accurate feedback to the brake mechanism so that an accurate amount of braking force is applied to the roll to directly compensate for the inertia of the roll and thus maintain an accurate tension control downstream of the unwinding device. In addition, the present invention provides a further input in the form of actual measured tension downstream of the roll which is used to compensate for any difference which may occur between the actual tension in the web and the desired tension due to the primary brake control system which utilizes inertia compensation.

The present system measures both the rpm of the roll of web material being unwound and the line speed of the web with tachometer-generators which generate signals proportional to the rpm and line speed. The line speed output signal is divided by the rpm output signal and the result is a signal proportional to the roll diameter.

This diameter signal is then operated upon by a series of potentiometer controlled circuits. One of the potentiometer circuits permits the desired tension in the web to be introduced by operator adjustment so that the output signal is modified accordingly. These circuits also establish the operating range of the braking force and thus the range of tension which can be established in the web and also provide for the rate at which braking forces can be increased or decreased in order to prevent either breakage of the web or loss of tension due to rapid changes in conditions. A further adjustment on the output signal is provided to introduce a stall or minimum tension which is useful in preventing the roll of material from unwinding when the line is shut down since otherwise zero braking force might be applied to the roll.

The output signal from the last potentiometer circuit is then fed to an air brake control system in the form of a current-to-pressure converter which converts the electrical input signal representing the desired tension in the web at the present roll diameter, into an air pressure output signal proportional to the braking force necessary to obtain the desired tension. The output air pressure of the current to pressure converter is then preferably fed to an air rate multiplier which directly controls an air brake associated with the support spindle for the roll of material being unwound and applies the correct amount of braking force to obtain the desired tension.

The signal representing the roll diameter is also received in another part of the control circuitry where it is modified in turn to represent the square of the diameter and then combined with an operator adjusted input constant representing the density of the web material multiplied by the width of the roll of web. The resulting output signal is then proportional to the inertia in the roll.

The line speed measuring device, such as a tachometer-generator, is used to produce a signal which represents acceleration or deceleration in the web line speed. This signal is then combined with the signal representing the inertia in order to produce a further output signal proportional to the energy in the roll. This output signal is then added to the main web tension signal discussed above, and introduced into the current to pressure converter to further change the braking force to compensate for the energy in the roll as the line speed is increasing or decreasing.

With these two signals, i.e. the main desired web tension signal and the energy signal being utilized to control the current to pressure converter and thus the pressure applied to the air brake, substantially all of the control essential to operation of the device is provided. However, in order to obtain an even finer adjustment to more accurately establish the desired web tension it is also contemplated that a web tension measuring device can be provided to introduce a further feedback to the system. Such a web tension measuring device, for example, a simple linear transducer supported by dancer roll, can be positioned in contact with the web downstream from the roll of web material and produces an output signal which can be added to the main desired web tension signal and the signal proportional to the energy in the roll if the measured tension is other than the desired web tension so that further adjustment of the braking force can be obtained. In addition, it is contemplated that an antihunt feature be associated with the tension measuring device in order to prevent the constant addition and subtraction of a braking force to the roll due to very small fluctuations in the difference between the measured tension and the desired web tension introduced through the roll diameter calculations. This device simply prevents feedback of a signal from the tension measuring transducer if it is below a predetermined value and thus permits the measured tension to fluctuate within the given range relative to the calculated tension or actual applied tension established through the roll diameter and energy calculation inputs.

BRIEF DESCRIPTION OF THE DRAWINGS

The FIGURE is a schematic illustration of the system of the present invention applied to an unwinding roll of web material.

DETAILED DESCRIPTION OF THE PREFERRED EMBODIMENT

The system of the present invention can be utilized in connection with any operation where a roll of web material is being unwound where it is important to maintain substantially uniform tension on the web during the unwinding sequence. However, the present system will be described in the context of paper unwinding equipment which is the area of its intended primary utilization.

As illustrated in the FIGURE, a roll of paper 10 is supported at its core by a spindle 12 which is mounted at its ends for rotation in an unwinding device (not shown) of the type commonly used in the paper processing industry. Associated with the spindle at one or both ends thereof are friction braking pads 14 and 16 which engage the spindle surface in order to apply braking force to the roll of material being unwound. The present invention can be utilized with any type of variable braking force application apparatus, but will be described in association with an air brake for the purpose of example.

The air brake is schematically shown in the FIGURE as comprised of the two friction shoes 14 and 16 supplied with air through air line 18 to cause engagement of the friction shoes with opposing sides of the cylinder supporting the roll 10. Such braking mechanisms can be applied to either one or both sides of the roll as is desired. The web W which is being unrolled in the FIGURE in the direction of arrow A passes through a pair of rollers 20 and 22, the latter of which is associated with or contains a tachometer-generator of conventional construction which produces an electrical output signal proportional to the line speed of the moving web.

A further tachometer-generator 24 is associated with the spindle 12 and produces an electrical output signal proportional to the rpm of the rotating roll 10.

The output from both tachometer-generators 22 and 24 are fed to a computing device 26 such as a digital processor or analog circuit which can perform a division calculation continuously as it receives the signals from the speed reference and tachometer-generator 24. The computing device 26 divides the signal proportional to the line speed by the signal proportional to the rpm to in turn produce an output signal proportional to the roll diameter $D_r$ of the unwinding roll of web material 10. This output signal is then passed through a series of potentiometer control circuits represented schematically in the FIGURE by members 28, 30, 32, 34 and 36. All of these potentiometer circuits utilize adjustable potentiometers to permit adjustment of the output signals from each circuit according to the given factors which they each control as are explained in detail below. It is to be understood that other electrical components are associated with each potentiometer circuit to effect the desired modification of the input signal from the computing device 26. However, since such circuitry is conventional and well known the details thereof will not be discussed.

The potentiometer control circuit 28 is used to establish the maximum possible braking force that can be applied to the roll 10 in response to a change in condition. The potentiometer in this circuit is set for a given braking system in order to prevent damage to the equipment which might otherwise result if a greater tension output signal were received and a greater force applied by the braking system. This circuit provides a limit on the maximum signal strength permitted to pass and any incoming signal from the computing device 26 which is larger is reduced to the maximum level.

In order to control the rate at which the tension increases or decreases a further potentiometer control circuit represented by a member 30 in the FIGURE is provided which through a potentiometer permits adjustment of the rate of increase or decrease of the braking force signal due to any change in tension within the available range.

The potentiometer control circuit 32 receives the output signal from circuit 28 and produces an output signal proportional to the desired tension in the web. A potentiometer is provided in this circuit to permit the operator to manually adjust the web tension. This circuit establishes the main or course signal for producing a braking force proportional to the roll diameter. The potentiometer control circuit 32 is calibrated to produce an output signal that will result in an appropriate braking force being applied to the spindle 12 by the shoes 14 and 16 as the roll diameter continually decreases. Thus it can be seen, that as the roll diameter decreases the braking force applied to the roll 10 will decrease in direct proportion and thus maintain substantially uniform web tension at the desired level.

The further potentiometer control circuit 34 is adjusted to establish a minimum braking force which can be applied to the roll. There are many operating conditions in which the present system can be used which do not require control of the tension to or close to a zero level and thus the minimum tension can be set somewhere beneath or at the lower end of the range of operating tensions for the given unwinding process. As a lower limit on the minimum tension set by this circuit, the current-to-pressure converter characteristics must be taken into account. Such current-to-pressure converters generally do not operate down to a zero pressure output level and require some current input in order to be operative. Thus the minimum tension setting can be established through the adjustment of potentiometer control circuit 34 and is generally equal to the lower operating level of current of the current-to-pressure converter since no control on the converter would exist below that minimum setting. As is discussed in more detail below, however, the pressure output from the current-to-pressure converter can be adjusted to provide any range of pressures from zero up to any desired maximum pressure level.

A further potentiometer control circuit 36 is utilized to manually establish the stall tension level. This circuit is operative in such a manner that when the input signal from potentiometer control circuit 34 reaches the stall tension signal level the stall tension will automatically be applied at and below that level in order that the braking force applied to the roll 10 does not drop to zero. This is utilized in order to prevent the roll from unwinding while the operation is shut down.

The output signal from the last of this series of potentiometer control circuits is provided as the input to the above referred to current-to-pressure converter 40. The current-to-pressure converter 40 produces an output air pressure proportional to the current input from the potentiometer control circuit 36 which is in turn proportional to the roll diameter. This pressure output from the current-to-pressure converter 40 is then either used to directly control the braking force applied to the roll 10 or, if conditions require, is passed through an air rate multiplier 42 which provides a greater pressure range than is available directly from the current-to-pressure converter 40.

The output of the rate multiplier 42 is then in turn used to apply the braking force through brake shoes 14 and 16 to spindle 12. The air pressure which is applied to this brake control is predetermined to be at the level necessary to give the desired tension in web W. It can be seen that as the roll diameter calculation signal decreases the braking force applied will likewise decrease, thus maintaining uniform tension on the web W.

The above described circuit provides the main or course adjustment for controlling the braking force in order to maintain the desired web tension. However, as mentioned above in connection with the prior art, this is not sufficiently satisfactory for maintaining the accuracy required in some paper processing systems. Therefore, a further adjustment is provided which takes into account the energy contained in the rotating roll 10 and adjusts the braking force to compensate for accelerations and decelerations during the transient conditions of operation of the paper processing equipment.

To accomplish this the output signal from the roll diameter computing device 26 is introduced into a further computing device 44 of the same type as device 26 described above, and which produces an output signal proportional to the square of the roll diameter and essentially performs the function of multiplying the roll diameter input signal by itself to obtain the square of the diameter. The output signal of the computing device 44 is received by a further similar computing device 46.

Device 46 is utilized to produce an output signal proportional to the inertia of the roll. As a variable control on the output signal of device 46 an operator set potentiometer 48 is calibrated to provide introduction of a constant K equivalent to the roll density of the material being unwound from the roll 10 times the width of the roll. This constant K is in effect multiplied by the roll diameter squared to produced the output signal from device 46 proportional to the inertia $I_w$ of the roll.

This signal is further received by a computing device 48 of a similar type of those described above and which also receives a signal from the generator-tachometer 24 which measures the line speed of the web W. This later signal is first passed through a circuit represented by member 50 which determines whether or not the web is accelerating, decelerating or remains at a constant speed. If the speed is constant there is no output signal from the member 50. However, if there is acceleration or deceleration a signal proportional to the acceleration $A_c$ or deceleration $D_c$ is received in the computing device 48 from the member 50.

Device 48 then produces an output signal proportional to the energy E in the roll by essentially combining the input signals thereto so as to amount to the calculation of the energy by multiplying the inertia by either the acceleration or deceleration. The output signal from device 48 is then combined by summation with the output signal from potentiometer control circuit 36 and thus modifies the current input to the current-to-pressure converter 40 which in turn modifies the braking force applied to the roll 10 in order to compensate for the energy in the roll during either acceleration or deceleration.

In those situations where an even more exact control over the tension in the web is necessary, particularly under steady state conditions where the line speed of the web is constant, a further circuit is provided in the present invention which makes a comparison between the actual web tension of the moving web and the desired web tension produced by the above signal inputs and further adjusts the signal inputs so that the measured tension corresponds more precisely to the desired tension level. This is accomplished through a dancer roll 52 which engages the web downstream of the roll 10 being unwound.

Dancer roll 52 is resiliently supported and biases a portion of web W upward between two guide rolls 54 and 56. A linear transducer 58 is engaged with the dancer roll 52 so that vertical movement of the dancer roll as illustrated in the FIGURE will cause a signal output from the transducer 58 which is proportional to the tension in the web. This signal is then passed through an antihunt circuit represented by member 60 in the FIGURE which circuit only passes a signal therethrough if it is of sufficiently great enough magnitude to be above a predetermined level.

This antihunt device is provided in order to prevent the system from constantly readjusting the tension in the web due to minor errors within the permissible limits of tension error for a given application. An output signal from the antihunt device 60 is then combined by summation with the output signals of device 48 and potentiometer control circuit 36 to provide a further modification of the input signal to the current-to-pressure converter 40 to thus adjust the force supplied to the braking mechanism to adjust the tension in the web in order to bring the tension closer to the desired tension.

Although the foregoing illustrates the preferred embodiment of the present invention, other variations are possible. All such variations as would be obvious to one skilled in this art are intended to be included within the scope of the invention as defined by the following claims.

What is claimed is:

1. Apparatus for controlling the braking action of a roll of web material supported for rotation on an unwinding device, comprising:

means for continuously measuring line speed and rate of change thereof of said web downstream of said unwinding device and providing an output signal proportional to said line speed;

means for continuously measuring rotational speed of said roll of web and providing an output signal proportional to said rotational speed;

means receiving said output signals from said line speed and rotational speed measuring means and combining said signals to produce an output signal proportional to the diameter of said roll;

means receiving said output signal proportional to said roll diameter and producing an ouput signal proportional to a predetermined desired web tension downstream of said roll;

means receiving said output signals from said line speed and rotational speed measuring means and producing an output signal proportional to the energy in said roll;

braking means for applying variable braking force to said roll;

brake control means receiving the surmation of said output signals proportional to the roll diameter and the energy in said roll and producing an output signal to said braking means for causing said braking means to apply variable braking force thereto so as to substantially maintain said predetermined tension in said web as it is being unwound during acceleration, deceleration and constant web speed conditions.

2. Apparatus as defined in claim 1 including:

means for measuring the tension of said web downstream of said unwinding device and producing an output signal proportional to said measured web tension;

said brake control means receiving said output signal proportional to said measured tension and modifying said output signal to said braking means sufficiently to substantially compensate for any difference between said predetermined desired tension and said measured tension.

3. Apparatus as defined in claim 1 wherein said means for producing an output signal proportional to the energy in said roll includes:

means receiving said output signal proportional to the diameter of said roll and producing an output signal proportional to the square of the diameter of said roll;

means receiving said output signal proportional to the square of the diameter and producing an output signal proportional to the inertia of said roll, said last named means including means for manually adjustment to modify said output signal thereof to correspond to the density and width of said roll;

means receiving said output signal proportional to said line speed and producing an output signal proportions to the acceleration or deceleration of said roll, if any; and means combining said signals proportional to the inertia and the acceleration or deceleration of said roll to produce said output signal proportional to the energy in said roll.

4. Apparatus as defined in claim 2 including antihunt means interposed between said tension measuring means and said brake control means, for preventing modification of said predetermined tension when the difference between said predetermined tension and said measured tension is below a predetermined value.

5. Apparatus as defined in claim 3 wherein said brake control means includes:

a current to pressure converter for receiving said output signals proportional to a predetermined web tension, the energy in said roll and said measured tension, and producing a fluid pressure output therefrom proportional to the summation of said signals received thereby;

said braking means receiving said output pressure and applying substantially sufficient braking force to said roll to maintain said desired tension in said web.

6. Apparatus as defined in claim 5, including:

fluid pressure multiplying means for receiving said output pressure from said current to pressure converter and multiplying said output pressure to a desired level to provide sufficient pressure to said braking means to maintain said desired tension in said web.

7. A method of controlling the braking action of a roll of web material supported for rotation on an unwinding device, the steps comprising:

continuously measuring line speed and the rate of change thereof of said web downstream of said unwinding device;

and providing an output signal proportional to said line speed;

continuously measuring rotational speed of said roll of web;

continuously calculating the diameter of said roll from said line speed and rotational speed measurements;

continuously calculating the energy in said roll from said rate of change of said line speed and said roll diameter;

continuously calculating the braking force needed to apply a predetermined tension to said web from said diameter and energy calculations; and applying said braking force to said roll.

8. A method as defined in claim 7 including the steps of:

measuring the tension in said web downstream of said roll;

comparing said measured tension to said predetermined tension;

modifying said braking force sufficiently to correct said calculated braking force to obtain said predetermined tension in said web.

9. A method as defined in claim 8 including the step of preventing the correction of said braking force if the difference between said predetermined tension and said measured tension is less than a predetermined value.

10. A method as defined in claim 7 wherein said step of continuously calculating the energy in said roll includes:

squaring the diameter of said roll and multiplying said squared diameter by a predetermined constant proportional to the density and width of said roll to obtain the inertia of said roll;

continuously calculating the acceleration or deceleration of said roll; and multiplying said inertia by said acceleration or deceleration to obtain said energy in said roll.

* * * * *